US009073327B1

(12) United States Patent
Wyble

(10) Patent No.: US 9,073,327 B1
(45) Date of Patent: Jul. 7, 2015

(54) PRINTHEAD CLEANING SYSTEM HAVING AN ELONGATED MEMBER CONNECTED TO A VACUUM SOURCE

(71) Applicant: Xerox Corporation, Norwalk, CT (US)

(72) Inventor: Thomas J. Wyble, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/180,386

(22) Filed: Feb. 14, 2014

(51) Int. Cl.
*B41J 2/165* (2006.01)

(52) U.S. Cl.
CPC ..... *B41J 2/16541* (2013.01); *B41J 2/1652* (2013.01); *B41J 2/16523* (2013.01); *B41J 2/16532* (2013.01)

(58) Field of Classification Search
CPC ..... B41J 2/16585; B41J 2/16526; B41J 2/16535; B41J 2/16547; B41J 2/16552; B41J 2/16523; B41J 2/185; B41J 2/16538; B41J 2/1707; B41J 2/16541; B41J 2/16532
See application file for complete search history.

(56) References Cited

U.S. PATENT DOCUMENTS

| | | | | |
|---|---|---|---|---|
| 5,548,310 | A | 8/1996 | Binnert et al. | |
| 5,572,243 | A | 11/1996 | Hermanson | |
| 5,594,477 | A | 1/1997 | Hilton | |
| 6,164,751 | A | 12/2000 | Griffin et al. | |
| 7,029,090 | B2 | 4/2006 | Nishida et al. | |
| 2008/0192083 | A1 * | 8/2008 | Nishida | 347/30 |

* cited by examiner

*Primary Examiner* — Lisa M Solomon
(74) *Attorney, Agent, or Firm* — Maginot Moore & Beck LLP

(57) ABSTRACT

A printer includes a printhead cleaning system that enables improved cleaning of the printhead and reduces nozzle contamination. The printer includes a pair of parallel walls and an elongated member extending through at least one of the walls. The elongated member is connected to a vacuum source and has a slit positioned between the pair of walls. A controller is operatively connected to the vacuum source and to an actuator, and operates the actuator to move a printhead into contact with the pair of walls to place a face plate of the printhead opposite the slit. The controller further operates the vacuum source to generate a vacuum in the elongated member to pull air into the elongated member when the printhead is opposite the slit.

19 Claims, 5 Drawing Sheets

PRINTHEAD CLEANING SYSTEM HAVING AN ELONGATED MEMBER CONNECTED TO A VACUUM SOURCE

TECHNICAL FIELD

This disclosure relates generally to inkjet imaging devices, and, in particular, to printhead cleaning apparatus for inkjet printheads.

BACKGROUND

In general, inkjet printers include at least one printhead that ejects drops of liquid ink directly onto recording media or onto a surface of an intermediate image receiving member for transfer to recording media. The intermediate image receiving member in an indirect inkjet printer can be a rotating metal drum or endless belt. In a direct printer, the recording media can be in sheet or continuous web form. A phase change inkjet printer employs phase change inks that are solid at ambient temperature, but transition to a liquid phase at an elevated temperature. Once the melted ink is ejected onto recording media or the surface of an intermediate image receiving member, the ink droplets quickly solidify to form an ink image.

Printers typically conduct various maintenance operations to ensure proper operation of the inkjets in each printhead. One known maintenance operation removes particles or other contaminants that may interfere with printing operations from each printhead in a printer. During such a cleaning maintenance operation, the printheads purge ink through some or all of the inkjets in the printhead. The purged ink flows from the apertures of the inkjets that are located in a faceplate of each printhead onto the faceplate.

In printheads that are oriented vertically or at least partially vertically, the purged ink rolls downwardly under the effect of gravity to an ink drip bib mounted at the lower edge of the faceplate or onto a flexure chute mounted on a maintenance station. The drip bib or flexure chute is configured to collect the liquid ink and direct the ink into an ink receptacle.

In some printers, including those mounted horizontally, one or more wipers are manipulated to contact the faceplate of each printhead and wipe the purged ink toward the drip bib to facilitate the collection and removal of the purged ink. However, when a large quantity of ink is present on the printhead face, such as after a purging operation, the wiper can sometimes smear the ink across the face of the printhead, leaving a layer of ink on the faceplate after the wiping is complete.

Additionally, when preparing a printhead for a period of non-use, some printheads are flushed with a cleaning fluid to loosen and/or remove solvents, resins, and other compounds from the inkjet nozzles. However, it is often difficult to remove all of the flushing fluid mixed with the solvents, resins, and other compounds. Wiping a printhead having these solvents, resins, and other compounds on the face can force these compounds into the inkjet nozzles, clogging and contaminating the nozzles.

Furthermore, in printheads configured to eject more than one color of ink, wiping the printhead mixes the ink on the printhead and forces some of the mixed ink into the inkjet nozzles. The mixed ink in the inkjet nozzles reduces print quality in subsequent printing operations or requires jetting of additional ink before commencing a printing operation to clear the nozzles, which results in wasted ink. Thus, improved cleaning of printheads is desirable.

SUMMARY

In one embodiment a printer includes a system to enable improved cleaning of the printhead faceplate and reduces contamination of the nozzles in the printhead faceplate. The printer includes a printhead, an elongated member, a pair of walls, a vacuum source, an actuator, and a controller. The printhead has an array of nozzles in a face plate, the face plate of the printhead having a width in a cross-process direction and a height in a process direction. The elongated member has a sealed end, an open end, and a slit extending at least partially between the sealed end and the open end of the elongated member. The walls are parallel to one another and separated from one another by a distance that is greater than the width of the printhead face plate in the cross-process direction and is less than a length of the elongated member from the sealed end of the elongated member to the open end of the elongated member. At least one of the walls has an aperture through which the elongated member is inserted and the other wall supports the sealed end of the elongated member at a position that holds the elongated member perpendicular to both walls. The aperture in the at least one wall is spaced from a face of the at least one wall at predetermined distance. The vacuum source is operatively connected to the open end of the elongated member proximate the aperture in the wall to enable air to be pulled into the slit in the elongated member. An actuator is operatively connected to the printhead to move the printhead between a position where the printhead can be operated to eject ink onto an image receiving member and a position where the printhead face plate engages the pair of walls and is opposite the slit in the elongated member at the predetermined distance. The controller is operatively connected to the actuator and the vacuum source and is configured to operate the actuator to move the printhead from the position where the printhead can be operated to eject ink onto an image receiving member to the position where the printhead face plate engages the pair of walls and is opposite the slit in the elongated member at the predetermined distance. The controller is further configured to operate the vacuum source when the printhead is at the position where the printhead face plate engages the pair of walls and is opposite the slit in the elongated member at the predetermined distance to pull debris and ink from the face plate of the printhead, and to operate the actuator to move the printhead back to the position where the printhead can be operated to eject ink onto an image receiving member.

In another embodiment, a method of cleaning a printhead improves cleaning performance and reduces nozzle contamination in the printhead. The method includes operating an actuator with a controller to move a printhead having an array of nozzles in a face plate from a position where the printhead can be operated to eject ink onto an image receiving member to a position where the printhead face plate engages a pair of walls that are parallel to one another and separated from one another by a distance that is greater than a width of the printhead face plate in a cross-process direction. A vacuum source operatively connected to an open end of an elongated member having a slit that extends between the open end of the elongated member and a sealed end of the elongated member, the elongated member extending between the walls in the pair of walls in a perpendicular direction to both walls through an aperture offset from a face of at least one of the walls at a predetermined distance, is operated with the controller, enabling air to be pulled into the slit in the elongated member as the slit is opposite the face plate of the printhead to pull debris and ink from the face plate of the printhead into the slit. The method further includes operating the actuator with the controller to move the printhead back to the position where the printhead can be operated to eject ink onto an image receiving member.

In yet another embodiment, a printhead cleaner improves printhead cleaning performance and reduces contamination of inkjet nozzles in a printhead. The printhead cleaner includes a pair of walls, which are parallel to one another and separated from one another by a distance that is greater than a width of a printhead face plate in a cross-process direction. At least one of the walls has an aperture through the at least one wall that is spaced from a face of the at least one wall at a predetermined distance. The printhead cleaner further includes an elongated member having a sealed end and an open end with a slit in the elongated member that extends at least partially between the sealed end and the open end of the elongated member. The elongated member has a length that is greater than the distance separating the pair of walls, and the elongated member extends through the aperture in the at least one wall to the other wall to enable the other wall to support the sealed end of the elongated member and the open end of the elongated member is accessible outside the pair of walls. The printhead cleaner also includes a connector configured to operatively connect a vacuum source to the open end of the elongated member proximate the aperture in the wall to enable air to be pulled into the slit in the elongated member.

DETAILED DESCRIPTION

Figure 1:
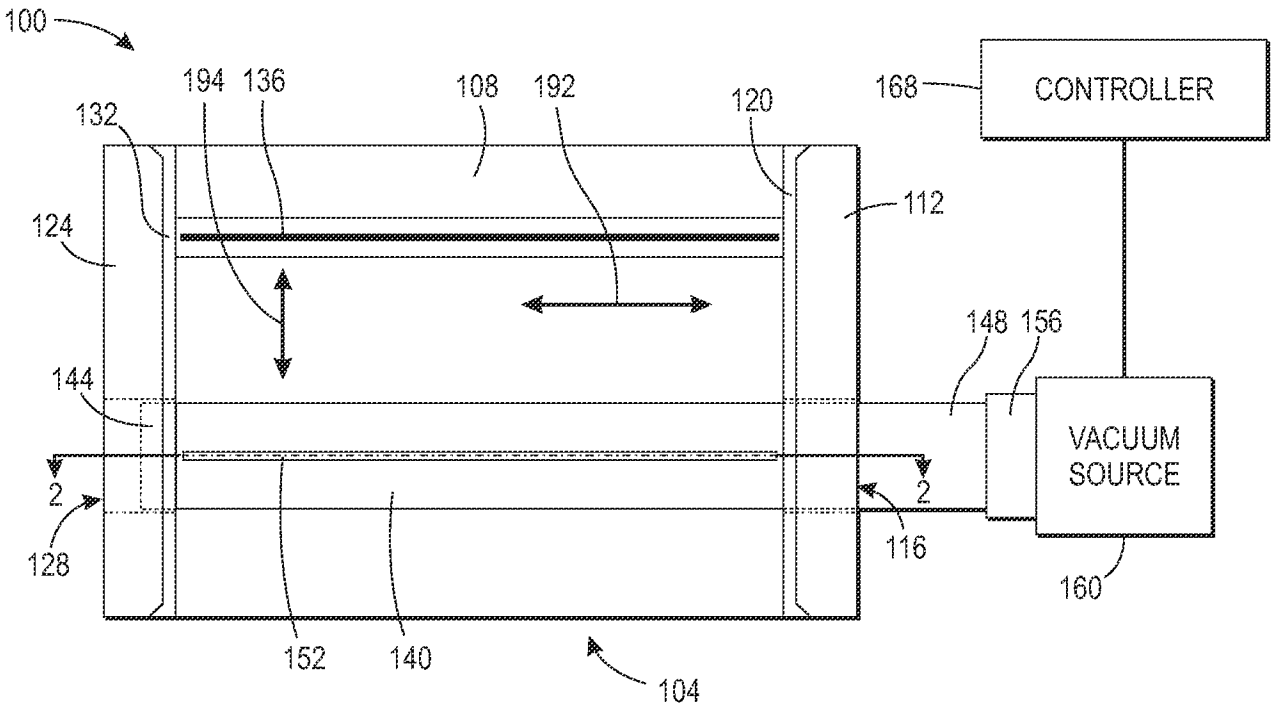
FIG. 1 is a top view of a printhead cleaning system.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data may include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct or indirect printer.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

In an indirect printer, the printheads eject ink drops onto the surface of an intermediate image receiving member, for example, a rotating drum or an endless belt. A transfix roller is selectively positioned against the intermediate image receiving member to form a transfix nip. As a media sheet passes through the transfix nip in synchronization with the ink image on the intermediate image receiving member, the ink image transfers and fixes to the media sheet under pressure and heat in the transfix nip. The transfer and fixation of the ink image are well known to the art and are referred to as a transfix process.

In a direct printer, the printheads eject ink drops directly onto a print medium, for example a paper sheet or a continuous media web. After ink drops are printed on the print medium, the printer moves the print medium through a nip formed between two rollers that apply pressure and, optionally, heat to the ink drops and print medium. One roller, typically referred to as a "spreader roller" contacts the printed side of the print medium. The second roller, typically referred to as a "pressure roller," presses the media against the spreader roller to spread the ink drips and fix the ink to the print medium.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like.

As used herein, the term "phase change ink" refers to a form of ink that is substantially solid at room temperature and transitions to a liquid state when heated to a phase change ink melting temperature for ejecting onto the image receiving member surface. The phase change ink melting temperature is any temperature that is capable of melting solid phase change ink into liquid or molten form. The phase change ink returns to the solid state after cooling on a print medium, such as paper, to form a printed image on the print medium.

Figure 5:
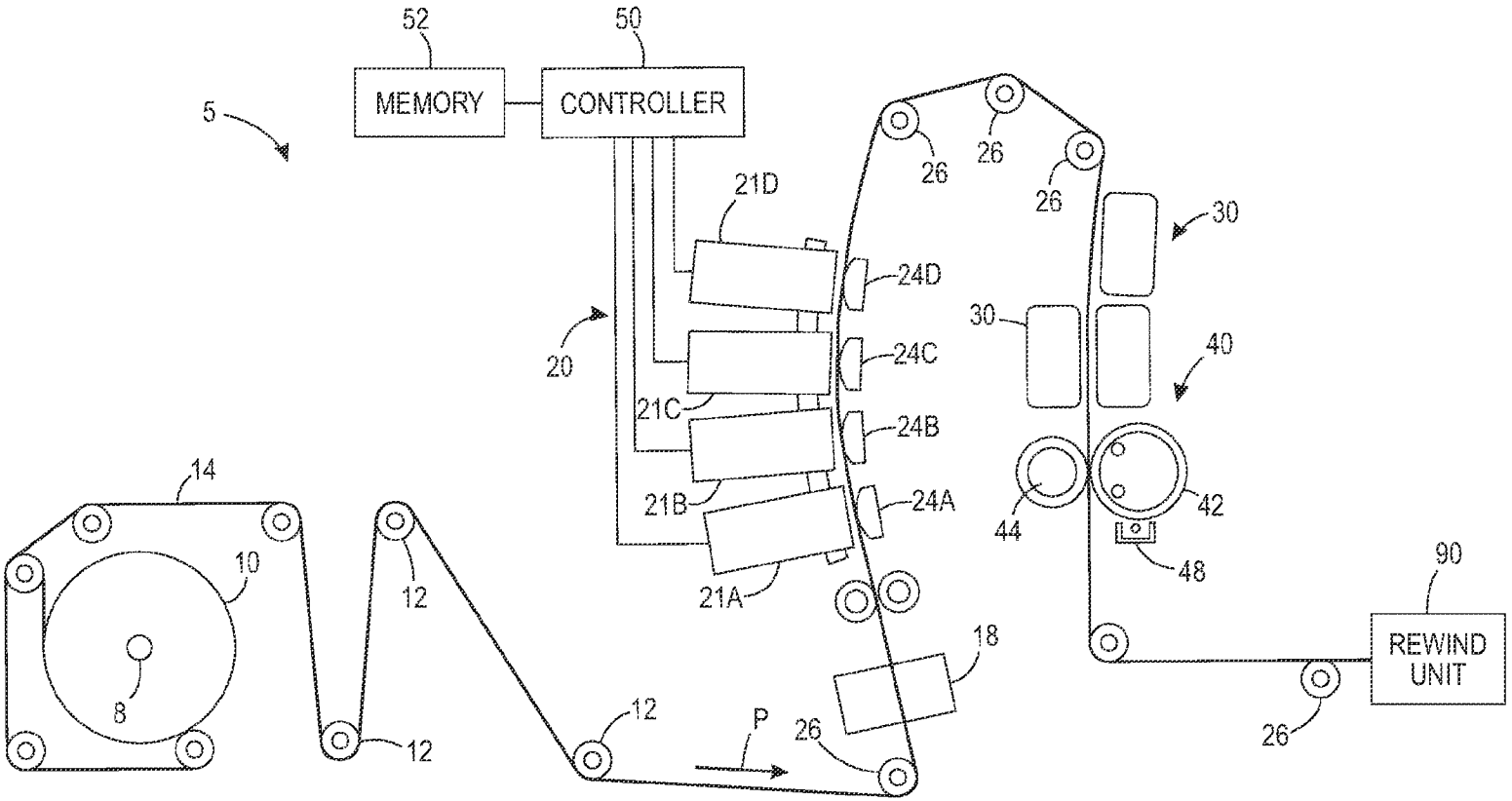
FIG. 5 PRIOR ART
FIG. 5 is a schematic diagram of a prior-art continuous direct-to-media printer.

FIG. 5 depicts a prior-art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The printer 5 is configured to print ink images with a phase-change ink. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance, which includes one or more dyes or pigments and which is applied to the media. The colorant can be black or any other desired color, and some printer configurations apply a plurality of different colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process. In the example of FIG. 5, the media web 14 is divided into a plurality of forms that are delineated with a series of form indicators that are arranged at predetermined intervals on the media web 14 in the process direction. Some webs include perforations that are formed between pages in the web to promote efficient separation of the printed pages.

The printer 5 includes a media transport using one or more actuators, such as electric motors, to rotate rollers that are arranged along the media path that move the media web 14 in the process direction P at a predetermined linear velocity. In the printer 5, the media web 14 is unwound from the source 10 as needed and a variety of motors, not shown, rotate one or more rollers 12 and 26 to propel the media web 14 in direction P. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media web 14 continues in direction P through the print zone 20 past a series of printhead units 21A, 21B, 21C, and 21D. Each of the printhead units 21A-21D effectively extends across the width of the media and includes one or more printheads that eject ink directly (i.e., without use of an intermediate or offset member) onto the media web 14. In printer 5, each of the printheads ejects a single color of ink, one for each of the colors typically used in color printing, namely, cyan, magenta, yellow, and black (CMYK).

The controller 50 of the printer 5 receives velocity data from encoders mounted proximately to the rollers positioned on either side of the portion of the path opposite the four printheads to calculate the linear velocity and position of the web as the web moves past the printheads. The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer.

Associated with each printhead unit is a backing member 24A-24D, typically in the form of a bar or roll, which is arranged substantially opposite the printhead on the back side of the media. Each backing member positions the media at a predetermined distance from the printhead opposite the backing member. The various backer members can be controlled individually or collectively. The pre-heater 18, the printheads, and the surrounding air combine to maintain the media along the portion of the path opposite the print zone 20 in a predetermined temperature range of about 40° C. to 70° C.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 5, the fixing assembly includes a "spreader" 40, which applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. The spreader 40 includes rollers, such as image-side roller 42 and pressure roller 44, to apply heat and pressure to the media.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50.

In the controller 50, the processors, their memories, and interface circuitry configure the controllers and/or print zone to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21D. The controller 50 generates electrical firing signals to operate the individual inkjets in the printhead units 21A-21D to eject ink drops that form printed images on the media web 14.

Figure 2:
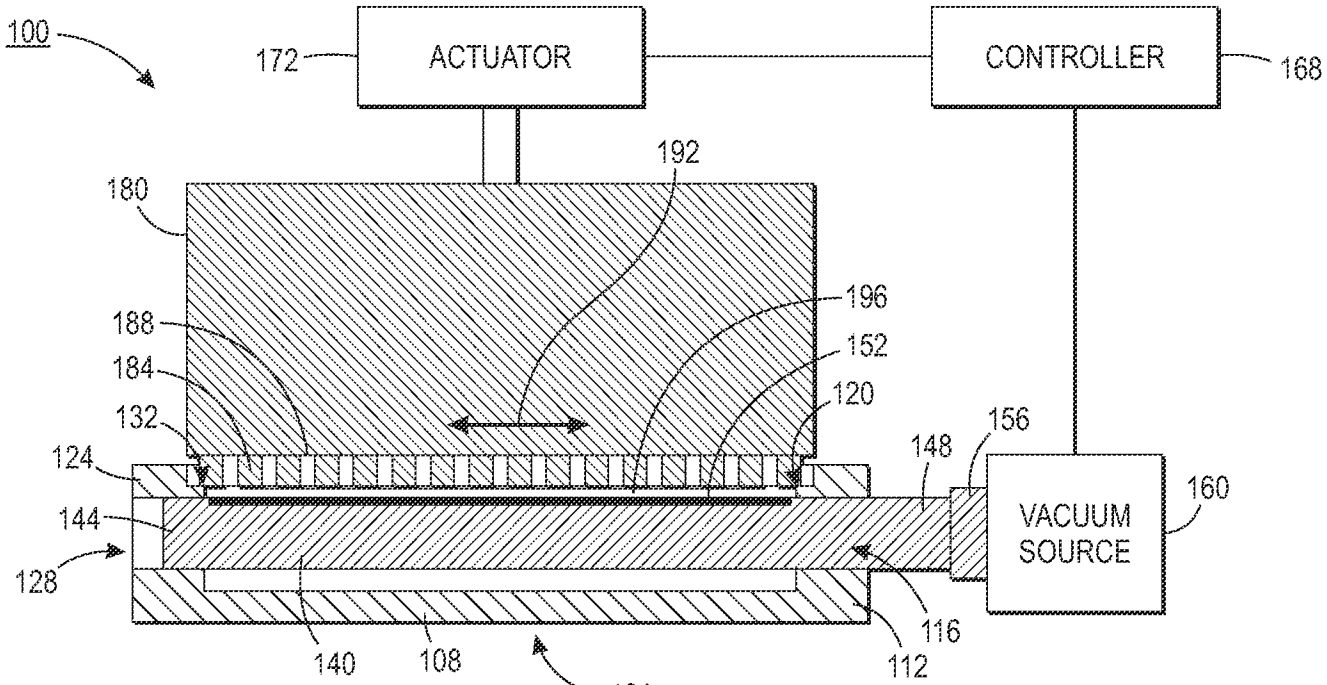
FIG. 2 is a cross-sectional side view of the printhead cleaning system of FIG. 1 taken along line 2-2 in FIG. 1, showing a printhead engaged with the printhead cleaning system.
Figure 3:
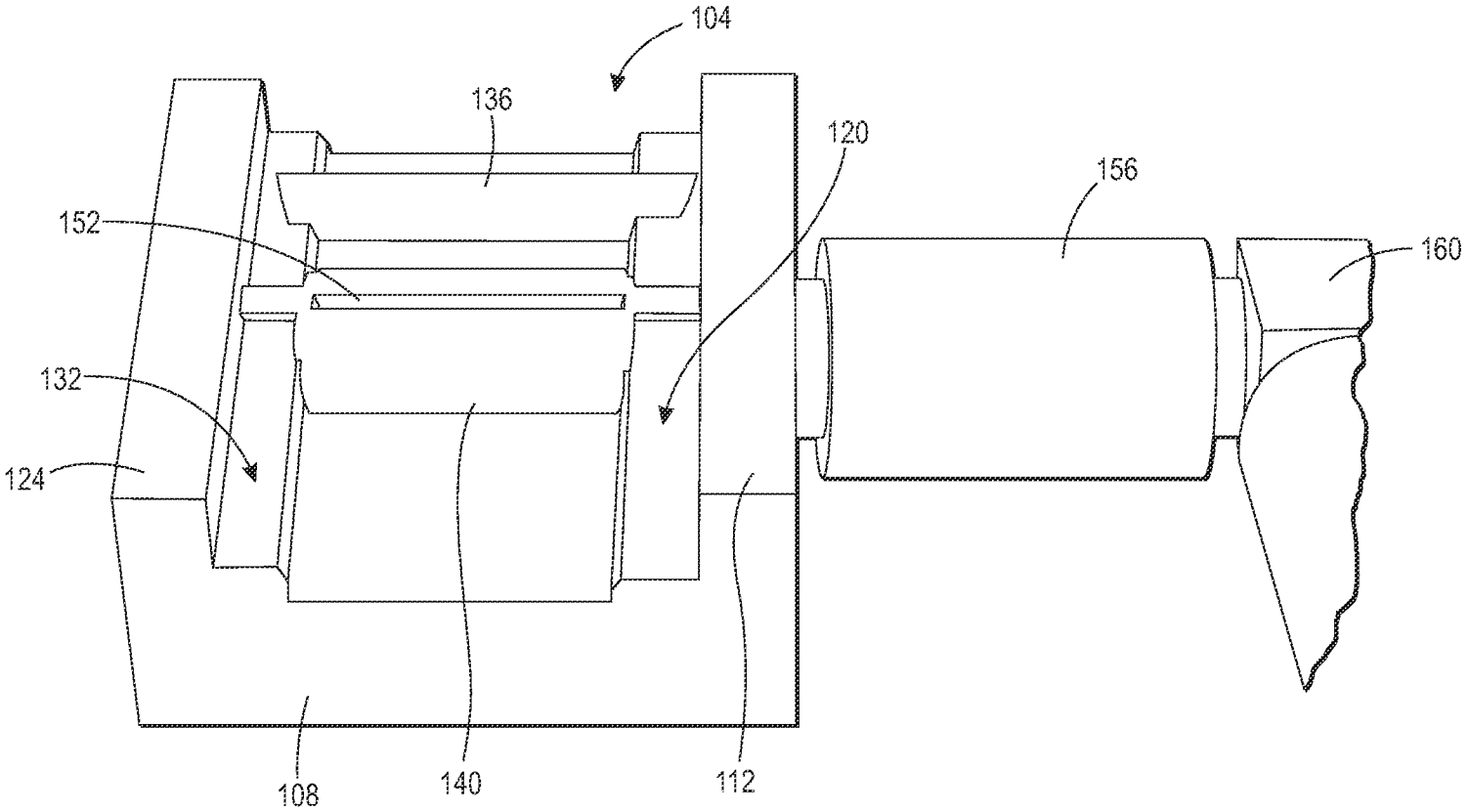
FIG. 3 is a front perspective view of the printhead cleaning system of FIG. 1.

A top view of a printhead cleaning system 100 is illustrated in FIG. 1, while FIG. 2 illustrates a cross-sectional view of the printhead cleaning system 100 along the line 2-2 of FIG. 1 and FIG. 3 illustrates a front perspective view of the printhead cleaning system 100. The printhead cleaning system 100 includes a holder 104, a cylindrical tube 140, a vacuum source 160, a controller 168, and an actuator 172. The holder 104 includes a base 108, a first wall 112, which defines a first aperture 116 and a first ledge 120, a second wall 124, which defines a second aperture 128 and a second ledge 132, and a wiper 136. The first and second walls 112, 124 are connected to one another by the base 108, and are located on opposite sides of the holder 104. The holder 104 can be formed of any desired rigid material that is compatible with the ink used in the printer, for example stainless steel or a thermoplastic such as polyoxymethylene (commonly sold under the trade name DELRIN), nylon, or acrylonitrile butadiene styrene (ABS).

As shown more clearly in FIG. 2, the first ledge 120 is defined by a surface that is recessed from a top surface of the first wall 112. Likewise, the second ledge 132 is defined by a surface recessed from a top surface of the second wall 124. The surfaces of the first and second ledges 120, 132 lie within the same plane to enable a faceplate 184 of a printhead 180 to rest against the first and second ledges 120, 132.

The first aperture 116 is a substantially circular bore extending through the first wall 112, while the second aperture 128 is a substantially circular bore extending through the second wall 124. Each of the first and second apertures 116, 128 have a diameter that is substantially the same as a diameter of the cylindrical tube 140. In some embodiments, the second aperture 120 does not extend fully through the second wall 124, but is instead a blind bore extending through only a portion of the second wall 124. In one embodiment, an uppermost point of each of the first and second apertures 116, 128 is spaced from the surface of the first and second ledges 120, 132 by between approximately 0.5 and 1 mm.

The wiper 136 extends across a width of the holder 104, between the first and second walls 112, 124, and projects upwardly above the height of the first and second ledges 120, 132. In one practical embodiment, the wiper 136 is formed of polyurethane, while in other embodiments the wiper is formed of another suitable flexible material.

The cylindrical tube 140 has a sealed end 144, an open end 148, and a slit 152. The sealed end 144 is configured to be positioned within the second aperture 128 and fits within the second aperture 128 to fix the sealed end 144 of the cylindrical tube 140 with respect to the holder 104. The slit 152 extends across the cylindrical tube 140 substantially the entire width between the first and second walls 112, 124. In one embodiment, a width of the slit is approximately 1 mm. The cylindrical tube 140 extends through the first aperture 116 and fits tightly in the first aperture 116 to fix the cylindrical tube 140 in the first aperture 116. The open end 148 of the cylindrical tube 140 extends beyond the holder 104, and includes a connector 156 configured to connect the open end 148 of the cylindrical tube 140 to the vacuum source 160. In some embodiments, the connector is attached to a hose or tube that is connected to the vacuum source. In some embodiments, the cylindrical tube 140 is connected to a tank that stores any ink collected in the cylindrical tube 140. While the illustrated embodiment includes a cylindrical tube 140, the reader should appreciate that another suitable elongated member can be used in place of the cylindrical tube, for example a rectangular prism, a trapezoidal prism, an elongated oval shaped tube, or another appropriate elongated member.

A printhead 180 is configured to rest on the ledges 120, 132 during a cleaning operation. The printhead has a faceplate 184 with a plurality of nozzles 188 arrayed in a cross-process direction 192 and a process direction 194, which is perpendicular to the cross-process direction 192. The printhead 180 can, for example, be a printhead in one of the printhead units 21A-21D described above with regard to FIG. 5. During the cleaning operation, which is described in more detail below with reference to FIG. 4, a vacuum generated in the slit 152 pulls ink and other debris off the faceplate 184 of the printhead 180 and the wiper 136 wipes any residual ink and debris from the faceplate 184 to clean the surface of the printhead faceplate 184.

The controller 168 is operatively connected to the vacuum source 160 and the actuator 172 to control the operation of the vacuum source 160 and the actuator 172. The controller 168 is implemented with general or specialized programmable processors that execute programmed instructions. The instructions and data required to perform the programmed functions are stored in memory associated with the controller 168. In some embodiments, the controller 168 is integrated with a printer controller, such as controller 50, which performs other operations within the printer in which the cleaning system is installed. In other embodiments, the cleaning system 100 includes a separate controller to operate the vacuum source 160 and the actuator 172.

In the controller 168, the processors, their memories, and interface circuitry configure the operation of the vacuum source 160 and the actuator 172. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 168 is operatively connected to the vacuum source 160 and the actuator 172, and generates electrical signals to operate the vacuum source 160 and the actuator 172.

Figure 4:
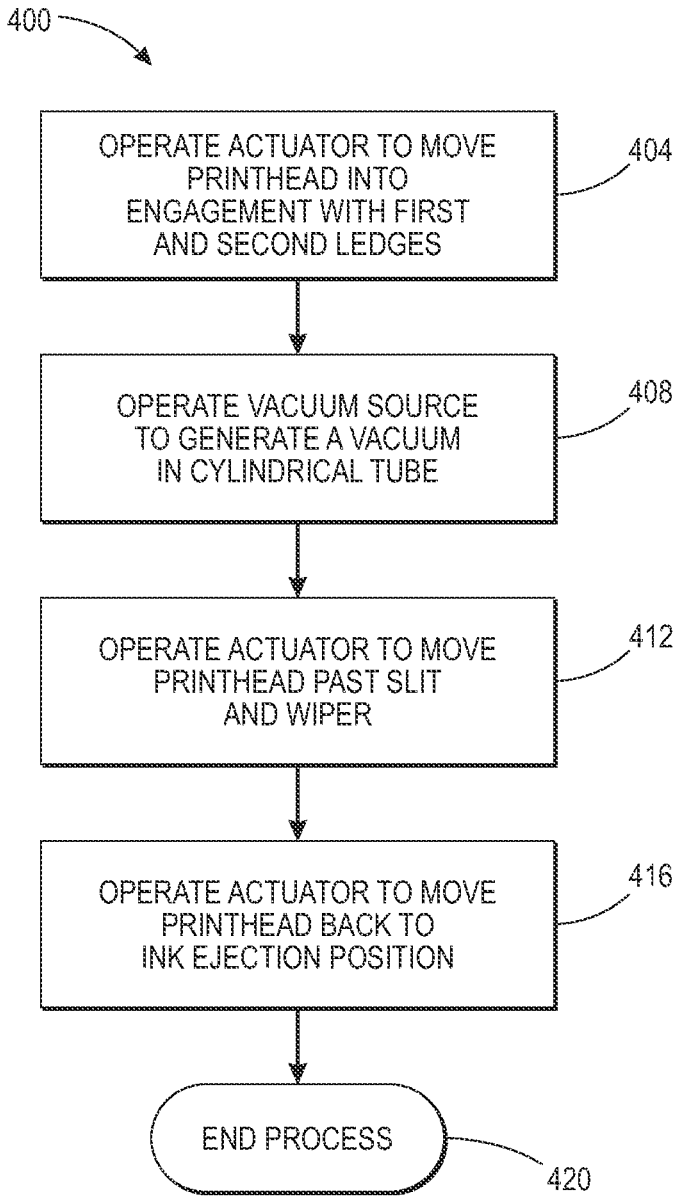
FIG. 4 is a process diagram of a method of cleaning a printhead.

FIG. 4 depicts a process 400 for operating a metering blade assembly. Description of the process 400 performing or doing some function refers to a controller, such as the controller 168 described above, executing programmed instructions stored in a memory operatively connected to the controller to cause the controller to operate one or more components of the printer to perform the specified function or action described in the process 400.

The process 400 begins with the controller 168 operating the actuator to move the printhead 180 from a position at which the printhead 180 is configured to eject ink onto an image receiving member to the printhead cleaning system 100 to perform a printhead cleaning operation. The controller 168 operates the actuator to position the printhead between the first and second walls 112, 124 so that the faceplate 184 of the printhead 180 contacts the first and second ledges 120, 132 of the holder 104 (block 404), as shown in FIG. 2. The faceplate 184 of the printhead 180 is separated from the slit 152 of the cylindrical tube 140 by a gap 196 equal to the distance between the uppermost point of the first and second apertures 116, 128 and the surface of the ledges 120, 132, which, in the one embodiment discussed above, is between approximately 0.5 mm and 1 mm. Additionally, the printhead 180 fits with little or no space between the sides of the printhead faceplate 184 and the first and second walls 112, 124 so that the walls 112, 124 disable movement of the printhead 180 in the cross-process direction 192 when the printhead 180 is located on the ledges 120, 132.

The controller 168 then activates the vacuum source 160 to generate a vacuum in the cylindrical tube 140 (block 408). Since the vacuum in the cylindrical tube 140 reduces the pressure in the cylindrical tube 140, the pressure in the cylindrical tube 140 is lower than the ambient pressure outside the cylindrical tube 140. As a result of this pressure differential, air is sucked into the cylindrical tube 140 via the slit 152.

The controller 168 operates the actuator 172 to move the printhead 180 upwardly in the view of FIG. 1 in the process direction 194 (block 412). The printhead 180 is moved such that the slit 152 passes over a first row of nozzles 188, pulling ink on the printhead faceplate 184 adjacent the first row of nozzles 188 into the slit 152. The actuator 172 continues moving the printhead 180 in the process direction 194 to move each row of nozzles 188 over the slit 152 to pull ink off the faceplate 184 and into the slit 152. As the printhead 180 is moved across the slit 152, the faceplate 184 passes over the wiper 136, beginning with the first row of nozzles 188, which has already passed over the slit 152. The wiper 136 deforms as the printhead faceplate 184 is moved across the wiper 136 and wipes the surface of the printhead faceplate 184, removing any residual ink left on the faceplate 184 after the ink and debris is sucked into the slit 152. Once the actuator 172 has moved all of the nozzles 188 of the printhead 180 over the slit 152 and then the wiper 136, the actuator 172 is operated to return the printhead 180 to the position at which the printhead 180 is configured to eject ink onto an image receiving member (block 416) and the process terminates (block 420).

The printhead cleaning system 100 and the process 400 operates to draw residual ink from a purging operation or from normal use and other debris and contaminants on the faceplate of a printhead into the cylindrical tube 140. Since a majority of the ink and other debris and contaminants are removed before the printhead is wiped, the subsequent wiping of the printhead is more effective, and the overall cleaning performance of the printhead cleaning system is improved. Additionally, residual ink collected in the cylindrical tube 140 can be collected in a tank and recycled for subsequent reuse.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a printhead having an array of nozzles in a face plate, the face plate of the printhead having a width in a cross-process direction and a height in a process direction;

an elongated member having a sealed end and an open end with a slit in the elongated member that extends at least partially between the sealed end and the open end of the elongated member;

a pair of walls, the two walls being parallel to one another and separated from one another by a distance that is greater than the width of the printhead face plate in the cross-process direction and is less than a length of the elongated member from the sealed end of the elongated member to the open end of the elongated member, at least one of the walls having an aperture through which the elongated member is inserted and the other wall supporting the sealed end of the elongated member at a position that holds the elongated member perpendicular to both walls, the aperture in the at least one wall being spaced from a face of the at least one wall at predetermined distance;

a vacuum source operatively connected to the open end of the elongated member proximate the aperture in the wall to enable air to be pulled into the slit in the elongated member;

an actuator operatively connected to the printhead to move the printhead between a position where the printhead can be operated to eject ink onto an image receiving member and a position where the printhead face plate engages the pair of walls and is opposite the slit in the elongated member at the predetermined distance; and a controller operatively connected to the actuator and the vacuum source, the controller being configured to operate the actuator to move the printhead from the position where the printhead can be operated to eject ink onto an image receiving member to the position where the printhead face plate engages the pair of walls and is opposite the slit in the elongated member at the predetermined distance, to operate the vacuum source when the printhead is at the position where the printhead face plate engages the pair of walls and is opposite the slit in the elongated member at the predetermined distance to pull debris and ink from the face plate of the printhead, and to operate the actuator to move the printhead back to the position where the printhead can be operated to eject ink onto an image receiving member.

2. The printer of claim 1 wherein the elongated member is a cylindrical tube.

3. The printer of claim 1 wherein the wall supporting the sealed end of the elongated member has an aperture in which the sealed end of the elongated member is supported.

4. The printer of claim 1 further comprising:

a wiper having a length approximately equal to the width of the face plate of the printhead, the wiper being affixed between the pair of walls and an edge of the wiper extending past the face of the at least one wall; and the controller being further configured to operate the actuator to move the face plate past the wiper to enable the wiper to wipe the face plate of the printhead after the face plate has been held at the position where the face plate of the printhead is opposite the slit in the elongated member for a first time period.

5. The printer of claim 1 wherein the wiper is affixed at a predetermined angle of orientation with reference to the face plate of the printhead.

6. The printer of claim 1, the controller being further configured to operate the actuator to position a last row of nozzles in the process direction past the face plate of the printhead opposite the slit in the elongated member when the actuator is operated to position the face plate opposite the slit in the elongated member and to operate the actuator to move the printhead at a predetermined speed in a direction that positions each row of nozzles in the array of nozzles opposite the slit in the elongated member.

7. The printer of claim 1 further comprising:

a wiper having a length approximately equal to the width of the face plate of the printhead, the wiper being affixed between the pair of walls and an edge of the wiper extending past the face of the at least one wall; and the controller being further configured to operate the actuator to continue to move the printhead at a predetermined speed in the direction that positions each row of nozzles in the array of nozzles opposite the slit in the elongated member to move the face plate past the wiper to enable the wiper to wipe the face plate of the printhead until each row of nozzles in the face plate has been wiped by the wiper.

8. The printer of claim 7, the controller being further configured to operate the actuator to move the printhead to the position where the printhead can be operated to eject ink onto the image receiving member after each row of nozzles in the face plate have been wiped by the wiper.

9. A method of operating a printer comprising:

operating an actuator with a controller to move a printhead having an array of nozzles in a face plate from a position where the printhead can be operated to eject ink onto an image receiving member to a position where the printhead face plate engages a pair of walls that are parallel to one another and separated from one another by a distance that is greater than a width of the printhead face plate in a cross-process direction;

operating with the controller a vacuum source operatively connected to an open end of an elongated member having a slit that extends between the open end of the elongated member and a sealed end of the elongated member, the elongated member extending between the walls in the pair of walls in a perpendicular direction to both walls through an aperture offset from a face of at least one of the walls at a predetermined distance, the operation of the vacuum source enabling air to be pulled into the slit in the elongated member as the slit is opposite the face plate of the printhead to pull debris and ink from the face plate of the printhead into the slit; and operating the actuator with the controller to move the printhead back to the position where the printhead can be operated to eject ink onto an image receiving member.

10. The method of printer operation of claim 9 wherein the elongated member is a cylindrical tube.

11. The method of printer operation of claim 9 further comprising:

operating the actuator with the controller to move printhead in a direction that passes the face plate past a wiper affixed between the pair of walls with an edge of the wiper extending past the face of the at least one wall, the wiper having a length approximately equal to the width of the face plate of the printhead, the movement of the face plate past the wiper enables the wiper to wipe the face plate of the printhead after the face plate has been held at the position where the face plate of the printhead is opposite the slit in the elongated member for a first time period.

12. The method of printer operation of claim 9 further comprising:

operating the actuator with the controller to position a last row of nozzles in a process direction along the face plate of the printhead opposite the slit in the cylindrical tube when the actuator is operated to position the face plate in engagement with the pair of walls; and operating the actuator with the controller to move the printhead at a predetermined speed in a direction that positions each row of nozzles in the array of nozzles opposite the slit in the elongated member.

13. The method of printer operation of claim 9 further comprising:

operating the actuator with the controller to move the printhead at a predetermined speed in a direction that positions each row of nozzles in the array of nozzles opposite the slit in the elongated member; and continuing to operate the actuator with the controller to move the face plate past a wiper having a length approximately equal to the width of the face plate of the printhead that is affixed between the pair of walls so an edge of the wiper extends past the face of the at least one wall to enable the wiper to wipe the face plate of the printhead until each row of nozzles in the face plate has been wiped by the wiper.

14. The method of printer operation of claim 13 further comprising:

operating the actuator with the controller to move the printhead to the position where the printhead can be operated to eject ink onto the image receiving member after each row of nozzles in the face plate have been wiped by the wiper.

15. A printhead cleaner comprising:

a pair of walls, the two walls being parallel to one another and separated from one another by a distance that is greater than a width of a printhead face plate in a cross-process direction, at least one of the walls having an aperture through the at least one wall that is spaced from a face of the at least one wall at a predetermined distance;

an elongated member having a sealed end and an open end with a slit in the elongated member that extends at least partially between the sealed end and the open end of the elongated member, the elongated member having a length that is greater than the distance separating the pair of walls, and the elongated member extending through the aperture in the at least one wall to the other wall to enable the other wall to support the sealed end of the elongated member and the open end of the elongated member is accessible outside the pair of walls; and a connector configured to operatively connect a vacuum source to the open end of the elongated member proximate the aperture in the wall to enable air to be pulled into the slit in the elongated member.

16. The printhead cleaner of claim 15 wherein the elongated member is a cylindrical tube.

17. The printhead cleaner of claim 15 wherein the wall supporting the sealed end of the elongated member has an aperture in which the sealed end of the elongated member is supported.

18. The printhead cleaner of claim 15 further comprising:

a wiper having a length approximately equal to the distance separating the pair of walls, the wiper being affixed between the pair of walls to enable an edge of the wiper to extend past the face of the at least one wall.

19. The printhead cleaner of claim 18 wherein the wiper is affixed between the pair of walls at a predetermined angle.

* * * * *